US010378173B2

(12) United States Patent
Sevoz et al.

(10) Patent No.: US 10,378,173 B2
(45) Date of Patent: Aug. 13, 2019

(54) METHOD OF BUILDING A FOUNDATION COMPRISING A STEEL MONOPILE AND A CONCRETE PART AND ASSOCIATED FOUNDATION FOR CONSTRUCTION WORK

(71) Applicant: SOLETANCHE FREYSSINET, Rueil Malmaison (FR)

(72) Inventors: Guy Sevoz, Montigny le Bretonneux (FR); Etienne Combescure, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 15/551,702

(22) PCT Filed: Feb. 20, 2015

(86) PCT No.: PCT/IB2015/000345
§ 371 (c)(1),
(2) Date: Aug. 17, 2017

(87) PCT Pub. No.: WO2016/132166
PCT Pub. Date: Aug. 25, 2016

(65) Prior Publication Data

US 2017/0350088 A1 Dec. 7, 2017

(51) Int. Cl.
*E02D 5/50* (2006.01)
*E02D 5/30* (2006.01)
(Continued)

(52) U.S. Cl.
CPC ..... *E02D 27/42* (2013.01); *E02D 5/30* (2013.01); *E02D 5/50* (2013.01); *E02D 7/00* (2013.01);
(Continued)

(58) Field of Classification Search
CPC .... E02D 5/30; E02D 5/48; E02D 5/50; E02D 7/02; E02D 27/42
(Continued)

(56) References Cited

U.S. PATENT DOCUMENTS 1,811,479 A * 6/1931 Squire ..... E02D 5/48 405/232
2,558,529 A * 6/1951 Thornley ..... E02D 5/48 405/245
(Continued)

FOREIGN PATENT DOCUMENTS

WO 2010/138978 A2 12/2010

*Primary Examiner* — Benjamin F Fiorello
*Assistant Examiner* — Stacy N Lawson
(74) *Attorney, Agent, or Firm* — Dentons US LLP

(57) ABSTRACT

The invention relates to a method of building a foundation (1) comprising a steel monopile (2) and a precast concrete part (3) on top of the monopile (2), comprising:—arranging a support structure (12) inside the monopile (2), the support structure (12) having a plurality of rods (16) extending radially with respect to a longitudinal axis of the monopile; —bringing the concrete part (3) above the monopile (2), with supporting columns (13) interposed between the support structure (12) and the concrete part (3), wherein reinforcement bars (14) protruding from a bottom surface (9) of the precast concrete part (3) extend downwardly beyond the support structure (12) by passing between the rods (16) of the support structure (12); —arranging tendons (15) between the support structure (12) and the concrete part (3) and tensioning the tendons (15); and—pouring concrete into an upper part of the monopile (2).

18 Claims, 3 Drawing Sheets

(51) Int. Cl.

| | |
|---|---|
| ***E02D 5/48*** | (2006.01) |
| ***E02D 27/42*** | (2006.01) |
| ***E02D 7/00*** | (2006.01) |
| ***E02D 7/02*** | (2006.01) |

(52) U.S. Cl.
CPC ..... *E02D 7/02* (2013.01); *E02D 2250/0023* (2013.01); *E02D 2300/002* (2013.01); *E02D 2300/0029* (2013.01)

(58) Field of Classification Search
USPC ..... 405/233, 250, 251, 252
See application file for complete search history.

(56) References Cited

U.S. PATENT DOCUMENTS

| | | | | | |
|---|---|---|---|---|---|
| 2,724,261 | A * | 11/1955 | Rensaa | E04B 1/0007 | 52/259 |
| 3,034,304 | A * | 5/1962 | Upson | E02D 5/385 | 405/243 |
| 3,145,540 | A * | 8/1964 | Baittinger | E02D 5/48 | 405/250 |
| 3,614,142 | A * | 10/1971 | Muller | E02D 27/16 | 403/179 |
| 5,826,387 | A | 10/1998 | Henderson et al. | | |
| 2011/0002744 | A1* | 1/2011 | Tadros | E02D 5/523 | 405/232 |
| 2013/0255169 | A1* | 10/2013 | Henderson | E04C 5/125 | 52/223.13 |
| 2014/0223846 | A1* | 8/2014 | Henderson | E04C 5/125 | 52/295 |
| 2014/0237923 | A1* | 8/2014 | Henderson | E04C 5/125 | 52/295 |

* cited by examiner

METHOD OF BUILDING A FOUNDATION COMPRISING A STEEL MONOPILE AND A CONCRETE PART AND ASSOCIATED FOUNDATION FOR CONSTRUCTION WORK

CROSS-REFERENCE TO RELATED APPLICATIONS

This application is a National Stage Application of International Application No. PCT/IB2015/000345 filed on Feb. 20, 2015, and is hereby incorporated by reference in its entirety for all purposes as if fully set forth herein.

TECHNICAL FIELD

The present invention relates to a method of building a foundation comprising a steel monopile and a precast concrete part on top of the monopile.

BACKGROUND

Usually, it is known to insert the steel monopile into a ground, with a driving hammer for instance.

Next, a connecting element made of concrete is poured on top of the steel monopile on which the precast concrete part is disposed to connect the steel monopile and the precast concrete part.

The connecting element is generally equipped with a reinforcement cage.

When several piles are arranged such that a pile cap extends on all the piles, there are larger room tolerances for positioning the pile cap and/or for positioning the precast concrete part on top of it relatively to the piles showing construction errors. The positioning can easily be achieved by minor adjustments on the pile cap reinforcement cage so that the tolerance in position of the concrete upper parts is not affected.

However, when only one monopile is used with its associated concrete part, for instance for an offshore wind turbine, there is needed matching diameters between the monopile and the associated concrete part and the geometrical tolerances are more restricted.

For instance, for a steel monopile diameter of 2.5 m, a horizontal tolerance is approximately 50 mm while a vertical tolerance is approximately 75 mm.

Nevertheless, such restricted tolerances are more difficult to work with because of the absence of the pile cap to adapt the piles construction errors. Adjustment capacities are then required to cope with construction errors of the monopile for horizontal position, height or tilt angle. Furthermore, the need for adjustment capacity should favorably have a limited impact on the duration of the whole construction process of a superstructure bearing onto the foundation.

BRIEF SUMMARY

The present invention aims at solving the above mentioned issues.

To this end, the invention relates to a method of building a foundation comprising a steel monopile and a precast concrete part on top of the monopile, the method comprising:

arranging a support structure inside the monopile, the support structure having a plurality of rods extending radially with respect to a longitudinal axis of the monopile;

driving the monopile into a ground;

bringing the precast concrete part above the monopile, with supporting columns interposed between the support structure and a transverse abutment surface of the precast concrete part to transfer the weight of the precast concrete part to the monopile, wherein reinforcement bars protruding from a bottom surface of the precast concrete part extend downwardly beyond the support structure by passing between the rods of the support structure;

arranging tendons between the support structure and the precast concrete part and tensioning the tendons to pre-stress the supporting columns; and pouring concrete into an upper part of the monopile such that the support structure and the supporting columns are embedded in concrete.

The invention also relates to a foundation for a construction work, the foundation comprising:

a steel monopile forced into a ground;

a precast concrete part on top of the monopile; and a connection plug between the monopile and the precast concrete part, wherein said connection plug comprises, embedded in concrete:

a support structure located inside the monopile, the support structure having a plurality of rods extending radially with respect to a longitudinal axis of the monopile;

supporting columns interposed between the support structure and a transverse abutment surface of the precast concrete part;

reinforcement bars protruding from a bottom surface of the precast concrete part and extending downwardly beyond the support structure by passing between the rods of the support structure; and tendons extending between the support structure and the precast concrete part to pre-stress the supporting columns.

Thanks to the claimed method and foundation, the connecting plug between the concrete part and the monopile withstands mechanical loads coming through precast concrete part once the foundation is achieved while an adjustment of the horizontal position of precast concrete part and an adjustment of the lengths of the supporting columns ensures a geometrical matching of the pile and the concrete part so that the concrete part can be positioned despite the pile construction errors.

The claimed method and foundation also ensures the communication to the monopile.

According to another aspect of the invention, a plurality of shear keys are provided on an inner surface of the monopile, at least in the upper part where the concrete is poured.

According to another aspect of the invention, the monopile has a circular cross-section and the support structure has an outer diameter that substantially matches an inner diameter of the monopile, wherein said shear keys comprise a pair of ring-shaped shear keys extending circumferentially along the inner surface of the monopile, wherein the method further comprises a step of positioning the support structure between the ring-shaped shear keys of said pair with a longitudinal gap such that the support structure is not rigidly connected to the monopile while driving the monopile into the ground.

According to another aspect of the invention, the method further comprises:

adjusting a positioning angle of the support structure about the longitudinal axis of the monopile after driving the monopile into the ground, to allow positioning of the protruding reinforcement bars between the rods of the support structure.

According to another aspect of the invention, the method further comprises:

securing the support structure to a lower shear key of said pair of ring-shaped shear keys prior to pouring the concrete.

According to another aspect of the invention, the method further comprises: connecting each rod to a respective supporting column thereto, an upper end of the supporting column having a bearing plate to receive the abutment surface of the precast concrete part.

According to another aspect of the invention, the method further comprises: adjusting a length and/or vertical position of at least one of the supporting columns after driving the monopile into the ground.

According to another aspect of the invention, the method further comprises: adjusting transversely to the longitudinal axis of the monopile an anchoring position of each of said tendon on the support structure.

According to another aspect of the invention, each rod of the support structure comprises two substantially parallel beams disposed with an interval therebetween, the step of arranging tendons between the support structure and the precast concrete part comprising, for each tendon:

inserting the tendon through a respective duct of the precast concrete part, into the interval between the two beams of a respective rod of the support structure and through a load transfer unit placed under the two beams of the respective rod, whereby the interval between the two beams accommodates a horizontal offset of the lower end of the tendon.

According to another aspect of the invention, the method further comprises a step of providing access to a lower side of the support structure prior to pouring the concrete through a central opening of the support structure.

According to another aspect of the invention, concrete is poured into the upper part of the monopile up to a top surface of a concrete ring forming part of the precast concrete part, upper ends of the tendons being anchored on said top surface of the concrete ring.

According to another aspect of the invention, a cylindrical formwork is arranged at a top end of the monopile to receive concrete poured in an annular region adjacent to an interface between the periphery of the monopile and the precast concrete part.

According to another aspect of the invention, said connection plug of the foundation further comprises a plurality of shear keys provided on an inner surface of the monopile.

According to another aspect of the invention, the monopile has a circular cross-section and the support structure has an outer diameter that substantially matches an inner diameter of the monopile, said shear keys comprising a pair of ring-shaped shear keys extending circumferentially along the inner surface of the monopile, the support structure being held between the ring-shaped shear keys of said pair.

According to another aspect of the invention, wherein said shear keys comprise ring-shaped shear keys extending along the inner surface of the monopile for providing shear strength between the concrete plug of the connection plug and the monopile.

According to another aspect of the invention, each rod of the support structure has a respective supporting column connected thereto, an upper end of the supporting column having a bearing plate to receive the abutment surface of the precast concrete part.

According to another aspect of the invention, each rod of the support structure comprises two substantially parallel beams disposed with an interval therebetween, each tendon being inserted through a respective duct of the precast concrete part, in the interval between the two beams of a respective rod of the support structure and through a load transfer unit placed under the two beams of the respective rod, whereby the interval between the two beams accommodates a horizontal offset of the lower end of the tendon.

BRIEF DESCRIPTION OF THE DRAWINGS

Other aspects and advantages of the invention will become apparent from the following detailed description of the specific embodiments of the invention, and the accompanying drawings, in which.

DETAILED DESCRIPTION

Foundation

Figure 1:
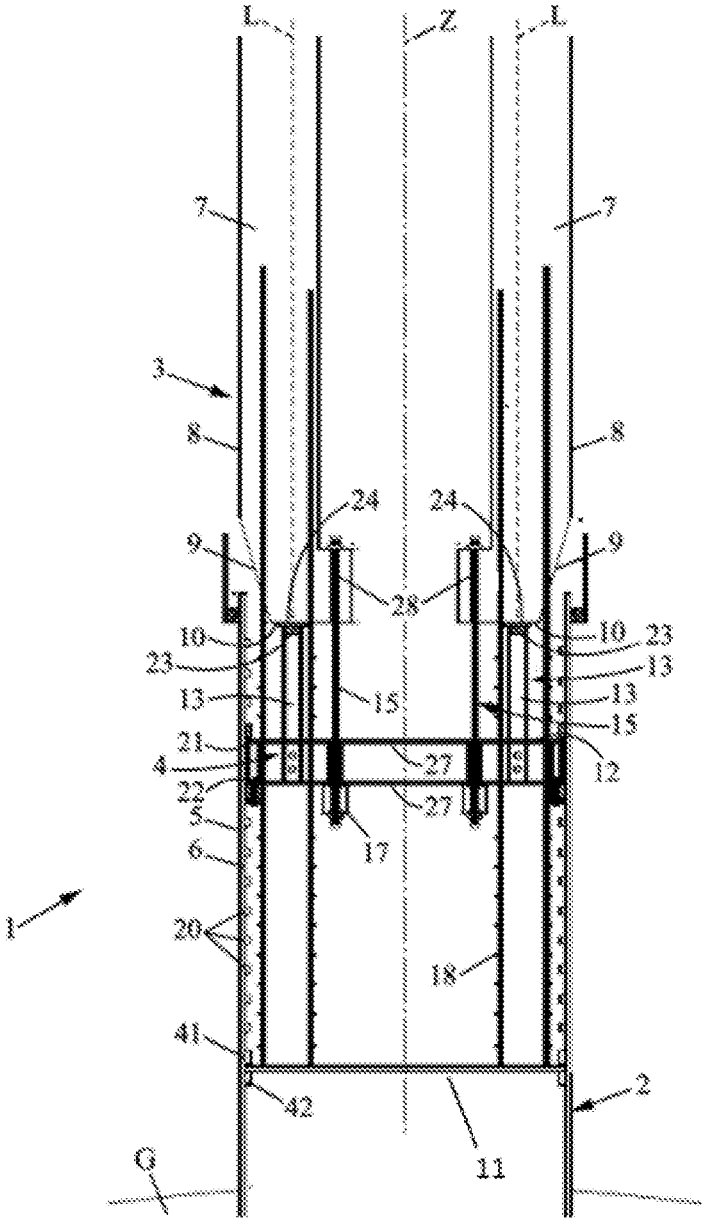
FIG. 1 illustrates a longitudinal section of a foundation according to the present invention.
Figure 2:
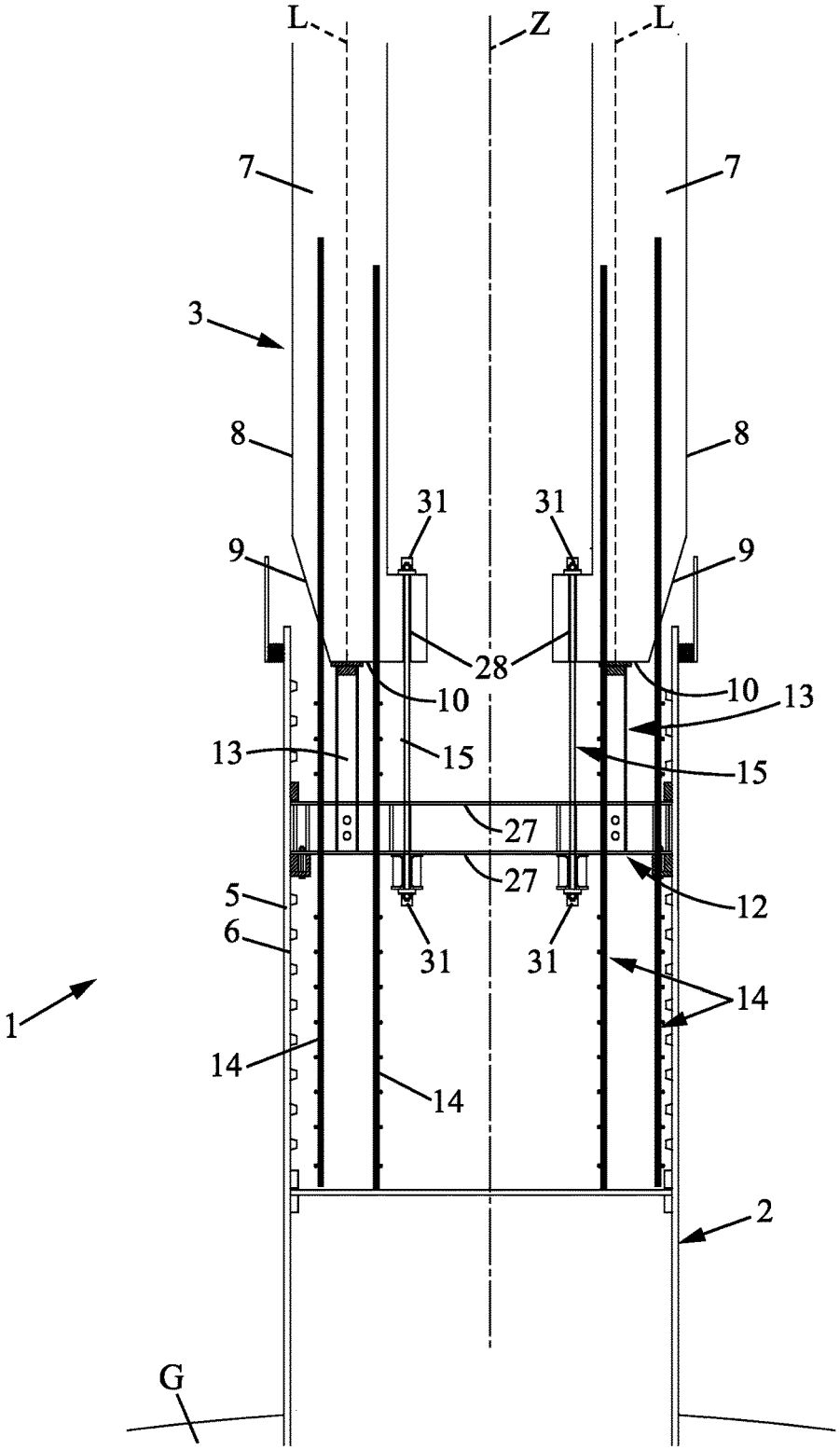
FIG. 2 illustrates the foundation of FIG. 1 with a horizontal offset.

As can be seen from FIGS. 1 and 2, a foundation 1 for a construction work comprises a steel monopile 2, a precast concrete part 3 and a connection plug 4 between the monopile 2 and the precast concrete part 3.

The steel monopile 2 is forced into a ground G such that the steel monopile 2 extends along a longitudinal axis Z that mainly corresponds to a vertical axis.

The monopile 2 is preferably of a cylinder form with a circular cross-section.

The monopile 2 comprises a longitudinal wall 5 that delimits an inner surface 6.

The precast concrete part 3 is disposed on top of the monopile 2.

As can be seen from FIG. 1, the precast concrete part 3 has a hollow structure, preferably with a cylinder form, favorably with a circular or polygonal cross-section.

The hollow structure of the precast concrete part 3 is delimited by concrete walls 7. The concrete walls 7 extend mainly along a longitudinal axis L that is parallel to the longitudinal axis Z of the monopile 2.

Longitudinal faces 8 of the walls 7 extend on top of the longitudinal wall 5 of the monopile 2.

Each wall 7 also comprises a bottom surface 9 that faces the connection plug 4.

An abutment surface 10 of the bottom surface 9 cooperates with the connection plug 4, as will be described later.

The connection plug 4 comprises, embedded in concrete (concrete not being illustrated), a support structure 12, supporting columns 13, and tendons 15.

The foundation 1 also comprises longitudinal reinforcement bars 14 that protrude from the precast concrete part 3.

The support structure 12 is located inside the monopile 2, the support structure 12 presenting an outer diameter that substantially matches an inner diameter of the monopile 2.

The support structure 12 has a plurality of rods 16 extending radially with respect to the longitudinal axis Z of the monopile 2.

The supporting columns 13 are interposed between the support structure 12 and the transverse abutment surface 10 of the precast concrete part 3.

The reinforcement bars 14 protrude from the precast concrete part 3 and extend downwardly beyond the support structure 12 by passing between the rods 16 of the support structure 12 to a diaphragm 11 forming bottom surface of the monopile 2.

As can be seen from FIGS. 1 and 2, the foundation 1 also comprises horizontal hoops 18 fixed to the longitudinal reinforcement bars 14.

The horizontal hoops 18 are stacked from the bottom of the pile 2 to the bottom surface 11 of the concrete part 3 such that the horizontal rings 18 and the longitudinal reinforcement bars 14 form a reinforcement cage of the connection plug 4.

The tendons 15 extend between the support structure 12 and the precast concrete part 3 to pre-stress the supporting columns 13 until a load transfer unit 17 of the connection plug 4, as will be detailed later.

The monopile 2 further comprises a plurality of shear keys 20 provided on its inner surface 6.

The shear-keys are welded to the inner surface 6 of the longitudinal wall 5 at least in the part of the monopile 2 where the concrete is poured.

The shear keys 20 comprise a pair of ring-shaped shear keys 21, 22 such that the support structure 12 is held between the ring-shaped shear keys 21, 22.

The ring-shaped keys 21, 22 extend circumferentially along the inner wall 6 of the monopile 2.

The upper ring-shaped key 21 faces the bottom surface 9 of the precast-concrete part 3 while the ring-shaped 22 faces the inner bottom surface 11 of the monopile 2.

A pair of shear keys 41, 42 holds the diaphragm 11 at a bottom side of the connection plug 4.

The ring-shaped shear keys 21, 22, 41, 42 have a rectangular profile.

Because the shear keys extend against the inner wall 6, the shear keys provide shear strength between the concrete connection plug 4 and the monopile 2.

A cylindrical formwork is arranged at a top end of the monopile to receive concrete poured in an annular region adjacent to an interface between the periphery of the monopile 2 and the precast concrete part 3.

Figure 4:
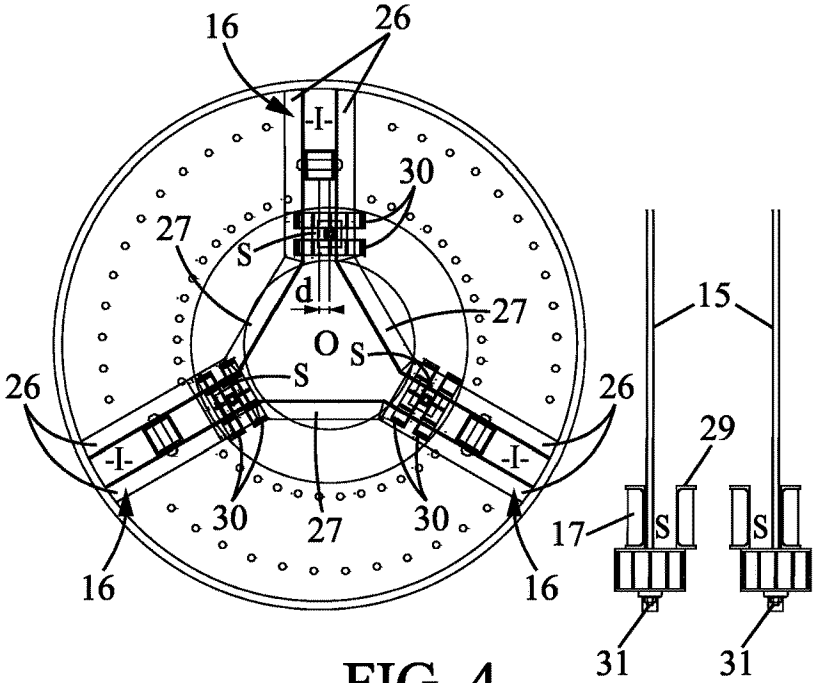
FIG. 4 illustrates a plan view of the support structure of FIG. 3 with the horizontal offset of FIG. 2.
Figure 3:
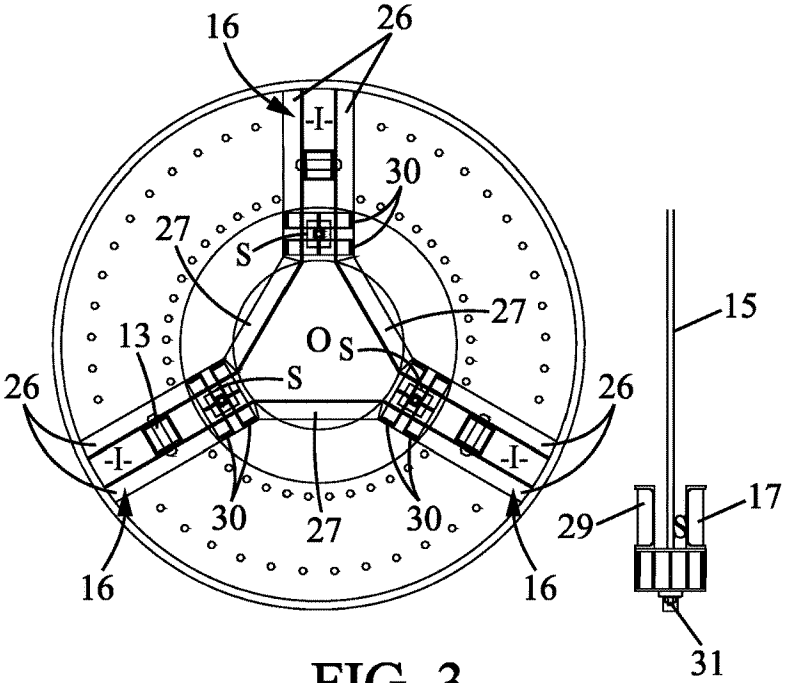
FIG. 3 illustrates a plan view of a support structure of the foundation of FIG. 1.

As can be seen from FIGS. 3 and 4, each rod 16 of the support structure 12 has a respective supporting column 13 connected thereto.

An upper end 23 of the supporting column 13 has a bearing plate 24 to receive the abutment surface 10 of the precast concrete part 3.

Advantageously, the bearing plate 24 is equipped with a flat jack that contributes to the levelling and pre-stressing of the columns 13.

Each rod 16 of the support structure 12 comprises two substantially parallel beams 26 disposed with an interval I therebetween.

As can be seen from the figures, the support structure 12 comprises three rods that are disposed such that two adjacent rods 16 form an angle of around 120°. The three rods 16 are comprised in a plane that is perpendicular to the Z axis.

The connection plug 4 further comprises three beams 27. Each beam 27 connects two beams 26 of two adjacent rods 16.

The three beams 27 constitutes a rigid frame connecting all the rods 16. The three beams 27 advantageously form an equilateral triangle.

The triangle delimits a central opening O of the support structure 12 that allows an access underneath to secure the tendons 15 and the supporting columns 13.

The load transfer unit 17 comprises three load transfer elements 29, each load transfer element 29 being associated with one rod 26.

Each load transfer element 29 comprises two parallel beams 30 defining a space S therebetween. The parallel beams 30 extend perpendicularly to the parallel beams 26 of the rods 16.

Each parallel beam 30 extends from one beam 26 of the associated rod 16 to the other beam 26.

Each tendon 15 is inserted through a respective duct 28 of the precast concrete part 3, in the interval I between the two beams 26 of the respective rod 16 of the support structure 12 and through the two parallel beams 30 of the load transfer element 29 placed under the two beams 26 of the respective rod 16.

Each tendon 15 is secured respectively to the precast concrete part 3 and to the connection plug 4 with nuts 31.

The interval I between the two beams 26 advantageously accommodates a horizontal offset of the lower end of the tendon 15 given that the tendons 15 can be inserted in a space of the interval I that is delimited by the space S of the beams 30 of the load transfer unit 17.

The horizontal offset is illustrated at FIGS. 2 and 4, the offset being shown by arrows and letter d (for distance) in FIG. 4.

For instance, the offset d can be of 50 mm.

As can be seen in FIGS. 2 and 4, a horizontal offset ensures that the precast concrete part 3 can be adjusted within prescribed horizontal tolerances.

An adjustment of a length of at least one of the supporting columns 13 accommodates a vertical offset such that the precast concrete part 3 can be adjusted within prescribed vertical tolerances and plumb tolerances.

Building Method

The invention also relates to a method of building a foundation comprising a steel monopile and a precast concrete part on top of the monopile, the method comprising several steps.

First, the monopile 2 is advantageously prepared by welding the shear keys 20, 21, 22 and 41, 42 to the inner surface 6 of the longitudinal wall 5.

Preferably, some hoops are reserved inside the monopile 2, these hoops being part of the reinforcement cage supported by the shear keys 20 and the diaphragm 11, as already explained.

The reserved hoops are the ones over which will be disposed the support structure 12.

Next, the support structure 12 is arranged inside the monopile 2.

Preferably, the positioning of the support structure 12 between the ring-shaped shear keys is made with a longitudinal gap such that the support structure is not rigidly connected to the monopile 2 while driving the monopile 2 into the ground.

Then, the monopile 2 is driven into the ground G.

Afterwards, the precast concrete part is brought above the monopile 2, the supporting columns 13 being interposed between the support structure 12 and the transverse abutment surface 10 of the precast concrete part 3 to transfer the weight of the precast concrete part 3 to the monopile 2.

A following step of the method of building consists in adjusting the position and the angles of the precast concrete part.

Then, the tendons 15 are arranged between the support structure 12 and the precast concrete part 3 and are tensioned to pre-stress the supporting columns 13.

The method of building also comprises a step of assembling the reinforcement cage between the monopile 2 and the precast concrete part 3 that comprises the reserved hoops, the reinforcement bars 14 protruding from precast concrete part and supplementary hoops that are disposed above the support structure 12.

Finally, concrete is poured into an upper part of the monopile 2 such that the support structure 12, the reinforcement cage and the supporting columns 13 are embedded in concrete.

Advantageously, prior to pouring the concrete, the building method comprises a step of securing the support structure 12 to the lower shear key 22 of the pair of ring-shaped shear keys 21, 22.

The method can also comprise a step of adding reinforcement bars.

The invention is not limited to the described kinematic and the sequence of the steps of the method of building can vary.

The adjustment of the position of the precast concrete part 3 depends mainly on adjusting the lengths of the supporting columns 13.

Indeed, the positioning of the precast concrete part 3 relatively to the Z axis is induced by the length of the supporting columns 13.

The adjustment of the length of the supporting columns 13 makes the precast concrete part 3 to be translated relatively to the monopile 2 and ensures to respect the vertical tolerances.

The supporting columns 13 can also be adjusted to present different length one from another, depending on the angle that that precast concrete should present relatively to a horizontal axis.

Moreover, the precast concrete part 3 can be adjusted within prescribed horizontal tolerances thanks to the horizontal offset already described.

The connection plug 4 provides a connection between the steel monopile and the precast concrete part to respect horizontal and vertical tolerances despite the pile construction errors.

The connection plug 4 also put the curing time out of the critical path, contrary to the existing state-in-the-art.

The invention claimed is:

1. A method of building a foundation comprising a steel monopile and a precast concrete part on top of the monopile, the method comprising:

arranging a support structure inside the monopile, the support structure having a plurality of rods extending radially with respect to a longitudinal axis of the monopile;

driving the monopile into a ground (G);

bringing the precast concrete part above the monopile, with supporting columns interposed between the support structure and a transverse abutment surface of the precast concrete part to transfer the weight of the precast concrete part to the monopile, wherein reinforcement bars protruding from a bottom surface of the precast concrete part extend downwardly beyond the support structure by passing between the rods of the support structure;

arranging tendons between the support structure and the precast concrete part and tensioning the tendons to pre-stress the supporting columns; and pouring concrete into an upper part of the monopile such that the support structure and the supporting columns are embedded in concrete.

2. The method as claimed in claim 1, wherein a plurality of shear keys are provided on an inner surface of the monopile, at least in the upper part where the concrete is poured.

3. The method as claimed in claim 2, wherein the monopile has a circular cross-section and the support structure has an outer diameter that substantially matches an inner diameter of the monopile, wherein said shear keys comprise a pair of ring-shaped shear keys extending circumferentially along the inner surface of the monopile, wherein the method further comprises a step of positioning the support structure between the ring-shaped shear keys of said pair with a longitudinal gap such that the support structure is not rigidly connected to the monopile while driving the monopile into the ground.

4. The method as claimed in claim 3, further comprising:

adjusting a positioning angle of the support structure about the longitudinal axis (Z) of the monopile after driving the monopile into the ground (G), to allow positioning of the protruding reinforcement bars between the rods of the support structure.

5. The method as claimed in claim 3, further comprising:

securing the support structure to a lower shear key of said pair of ring-shaped shear keys prior to pouring the concrete.

6. The method as claimed in claim 5, further comprising a step of connecting each rod to a respective supporting column thereto, an upper end of the supporting column having a bearing plate to receive the abutment surface of the precast concrete part.

7. The method as claimed in claim 6, further comprising:

adjusting a length and/or vertical position of at least one of the supporting columns after driving the monopile into the ground (G).

8. The method as claimed in claim 7, further comprising:

adjusting transversely to the longitudinal axis (Z) of the monopile an anchoring position of each of said tendon on the support structure.

9. The method as claimed in claim 8, wherein each rod of the support structure comprises two substantially parallel beams disposed with an interval therebetween, wherein the step of arranging tendons between the support structure and the precast concrete part comprises, for each tendon:

inserting the tendon through a respective duct of the precast concrete part, into the interval between the two beams of a respective rod of the support structure and through a load transfer unit placed under the two beams of the respective rod, whereby the interval between the two beams accommodates a horizontal offset of the lower end of the tendon.

10. The method as claimed in claim 9, further comprising a step of providing access to a lower side of the support structure prior to pouring the concrete through a central opening of the support structure.

11. The method as claimed in claim 10, wherein concrete is poured into the upper part of the monopile up to a top surface of a concrete ring forming part of the precast concrete part, upper ends of the tendons being anchored on said top surface of the concrete ring.

12. The method as claimed in claim 11, wherein a cylindrical formwork is arranged at a top end of the monopile to receive concrete poured in an annular region adjacent to an interface between the periphery of the monopile and the precast concrete part.

13. A foundation for a construction work, the foundation comprising:

a steel monopile forced into a ground (G);

a precast concrete part on top of the monopile; and a connection plug between the monopile and the precast concrete part, wherein said connection plug comprises, embedded in concrete:

a support structure located inside the monopile, the support structure having a plurality of rods extending radially with respect to a longitudinal axis (Z) of the monopile;

supporting columns interposed between the support structure and a transverse abutment surface of the precast concrete part;

reinforcement bars protruding from a bottom surface of the precast concrete part and extending downwardly beyond the support structure by passing between the rods of the support structure; and tendons extending between the support structure and the precast concrete part to pre-stress the supporting columns.

14. The foundation as claimed in claim 13, wherein said connection plug further comprises a plurality of shear keys provided on an inner surface of the monopile.

15. The foundation as claimed in claim 14, wherein the monopile has a circular cross-section and the support structure has an outer diameter that substantially matches an inner diameter of the monopile, wherein said shear keys comprise a pair of ring-shaped shear keys extending circumferentially along the inner surface of the monopile, wherein the support structure is held between the ring-shaped shear keys of said pair.

16. The foundation as claimed in claim 15, wherein said shear keys comprise ring-shaped shear keys extending along the inner surface of the monopile for providing shear strength between a concrete plug of the connection plug and the monopile.

17. The foundation as claimed in claim 16, wherein each rod of the support structure has a respective supporting column connected thereto, an upper end of the supporting column having a bearing plate to receive the abutment surface of the precast concrete part.

18. The foundation as claimed in claim 17, wherein each rod of the support structure comprises two substantially parallel beams disposed with an interval therebetween, wherein each tendon is inserted through a respective duct of the precast concrete part, in the interval between the two beams of a respective rod of the support structure and through a load transfer unit placed under the two beams of the respective rod, whereby the interval between the two beams accommodates a horizontal offset of the lower end of the tendon.

* * * * *